US005433046A

United States Patent [19]

MacQuarrie et al.

[11] Patent Number: 5,433,046

[45] Date of Patent: Jul. 18, 1995

[54] TELESCOPING PANEL CONSTRUCTION

[75] Inventors: Kenneth J. MacQuarrie, Aurora, Canada; Douglas D. Benner, Grand Rapids; Alexander A. Karrip, Newaygo, both of Mich.

[73] Assignee: Steelcase Inc., Grand Rapids, Mich.

[21] Appl. No.: 122,370

[22] Filed: Sep. 17, 1993

Related U.S. Application Data

[63] Continuation-in-part of Ser. No. 919,138, Jul. 23, 1992.

[51] Int. Cl.[6] ..... E04B 2/82

[52] U.S. Cl. ..... 52/238.1; 52/240; 52/243.1

[58] Field of Search ..... 52/238.1, 240, 242, 52/243.1

[56] References Cited

U.S. PATENT DOCUMENTS

| | | | |
|---|---|---|---|
| D. 293,981 | 2/1988 | Ball . | |
| 1,724,821 | 8/1929 | Bohnsack . | |
| 2,052,755 | 9/1936 | Duffy . | |
| 3,033,330 | 5/1962 | Fowles et al. . | |
| 3,083,417 | 4/1963 | Cook . | |
| 3,292,321 | 12/1966 | Vander Schans . | |
| 3,425,171 | 2/1969 | Propst et al. . | |
| 3,453,790 | 7/1969 | Harris . | |
| 3,464,170 | 9/1969 | Grover | 52/240 |
| 3,486,287 | 12/1969 | Guillon . | |
| 3,557,499 | 7/1969 | Dickie et al. . | |
| 3,592,289 | 7/1971 | Aysta et al. . | |
| 3,700,385 | 10/1972 | Sherwood . | |
| 3,802,146 | 4/1974 | Tacke et al. . | |
| 3,967,420 | 7/1976 | Papsco et al. . | |
| 3,990,204 | 11/1976 | Haworth et al. . | |
| 4,060,294 | 11/1977 | Haworth et al. . | |
| 4,127,196 | 11/1978 | Boucher . | |
| 4,133,153 | 1/1979 | Hage . | |
| 4,144,924 | 3/1979 | Vanden Hoek . | |
| 4,145,849 | 3/1979 | Shindoll et al. . | |
| 4,446,663 | 5/1984 | Stumpf et al. . | |
| 4,535,577 | 8/1985 | Tenser et al. . | |
| 4,685,255 | 8/1987 | Kelley . | |
| 4,731,961 | 3/1988 | Bona . | |
| 4,731,961 | 3/1988 | Bona . | |
| 4,833,840 | 5/1989 | Kalischewski et al. | 52/240 |
| 4,841,689 | 6/1989 | Schussler | 52/240 |
| B1 4,876,835 | 6/1992 | Kelly et al. . | |
| 4,876,835 | 10/1989 | Kelley et al. . | |
| 5,038,539 | 8/1991 | Kelley et al. . | |
| 5,125,202 | 6/1992 | Kissinger . | |
| 5,193,319 | 3/1993 | Claassen et al. | 52/238.1 |

FOREIGN PATENT DOCUMENTS

| | | |
|---|---|---|
| 129841 | 11/1948 | Australia . |
| 1024324 | 1/1978 | Canada . |
| 1026921 | 2/1978 | Canada . |
| 1046225 | 1/1979 | Canada . |
| 1055673 | 6/1979 | Canada . |
| 1058371 | 7/1979 | Canada . |
| 1218212 | 2/1987 | Canada . |
| 1229213 | 11/1987 | Canada . |
| 1233616 | 3/1988 | Canada . |
| 2041571 | 11/1991 | Canada . |
| 2617575 | 1/1989 | France . |
| WO9106727 | 5/1991 | WIPO . |

OTHER PUBLICATIONS

"Office Furniture Systems", Price List, by Teknion, dated Apr. 1983 (4 pgs.).

"Office Furniture Systems—3 Reasons Why . . . " by Teknion, dated Apr. 1983.

*Primary Examiner*—Carl D. Friedman

*Assistant Examiner*—Wynn E. Wood

*Attorney, Agent, or Firm*—Price, Heneveld, Cooper, DeWitt & Litton

[57] ABSTRACT

A vertically extensible self-storing partition panel includes a base panel having a lower portion shaped for freestanding support on a floor surface, and an upper portion with two vertically oriented support sleeves and a storage cavity therebetween. An inverted U-shape extender frame has opposite legs closely received in the support sleeves of the base panel, and permits shifting the extender frame between an extended position above the base panel, and a retracted position within the storage cavity of the base panel. When the extender frame is extended, a retainer holds the same in place, and at least one cover panel covers the open interior of the extender frame.

30 Claims, 10 Drawing Sheets

TELESCOPING PANEL CONSTRUCTION

CROSS-REFERENCES TO RELATED APPLICATIONS

The present application is a continuation-in-part of commonly assigned, co-pending U.S. patent application Ser. No. 07/919,138, filed Jul. 23, 1992, entitled EXPANDABLE PARTITION AND FRAMEWORK THEREFOR, which is hereby incorporated by reference.

BACKGROUND OF THE INVENTION

The present invention relates to portable partition panels, and in particular to a vertically extensible, self-storing partition panel.

Portable partition systems for open office spaces, and other similar settings are well known in the art. Individual partition panels are interconnected in different configurations to form separate offices or workstations. The partition panels are extremely durable, and can be readily disassembled and reassembled into alternative configurations to meet the everchanging needs of the user. Examples of such partition systems are provided in U.S. Pat. Nos. 3,831,330; 4,144,924, which are owned by Steelcase Inc., the assignee of the present application.

The ability to provide different height panels in any given furniture system has become a significant advantage in landscaping modern open office spaces. Heretofore, partition heights in a system could be varied by providing a plurality of different height panels, or alternatively vertically stacking smaller panels upon one another to achieve the desired panel height. Such prior furniture systems have certain drawbacks and disadvantages, particularly with respect to the need to inventory multiple panel sizes, and the storage of excess panels.

SUMMARY OF THE INVENTION

One aspect of the present invention is a vertically extensible self-storing partition panel, which includes a base panel having a lower portion shaped for freestanding support on a floor surface, and an upper portion with two vertically oriented support sleeves and a storage cavity therebetween. An inverted U-shape extender frame has opposite legs closely received in the support sleeves of the base panel, and permits shifting the extender frame between an extended position above the base panel, and a retracted position within the storage cavity of the base panel. When the extender frame is extended, a retainer holds the same in place, and at least one cover panel covers the open interior of the extender frame.

The principal objects of the present invention are to provide the vertically extensible partition panel which is self-storing. An extender frame can be easily extended to increase the overall height of the partition, and then retracted wholly within the base panel for storage. Brackets can be mounted to the extender frame to increase rigidity, and accommodate hang-on furniture accessories. A vertical jack may be provided to facilitate the extension and retraction of the extender frame, and may be operated by a power tool. The extender frame may be adapted to mount functional cover panels, such as glass panels, marker panels, etc. The partition panel is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
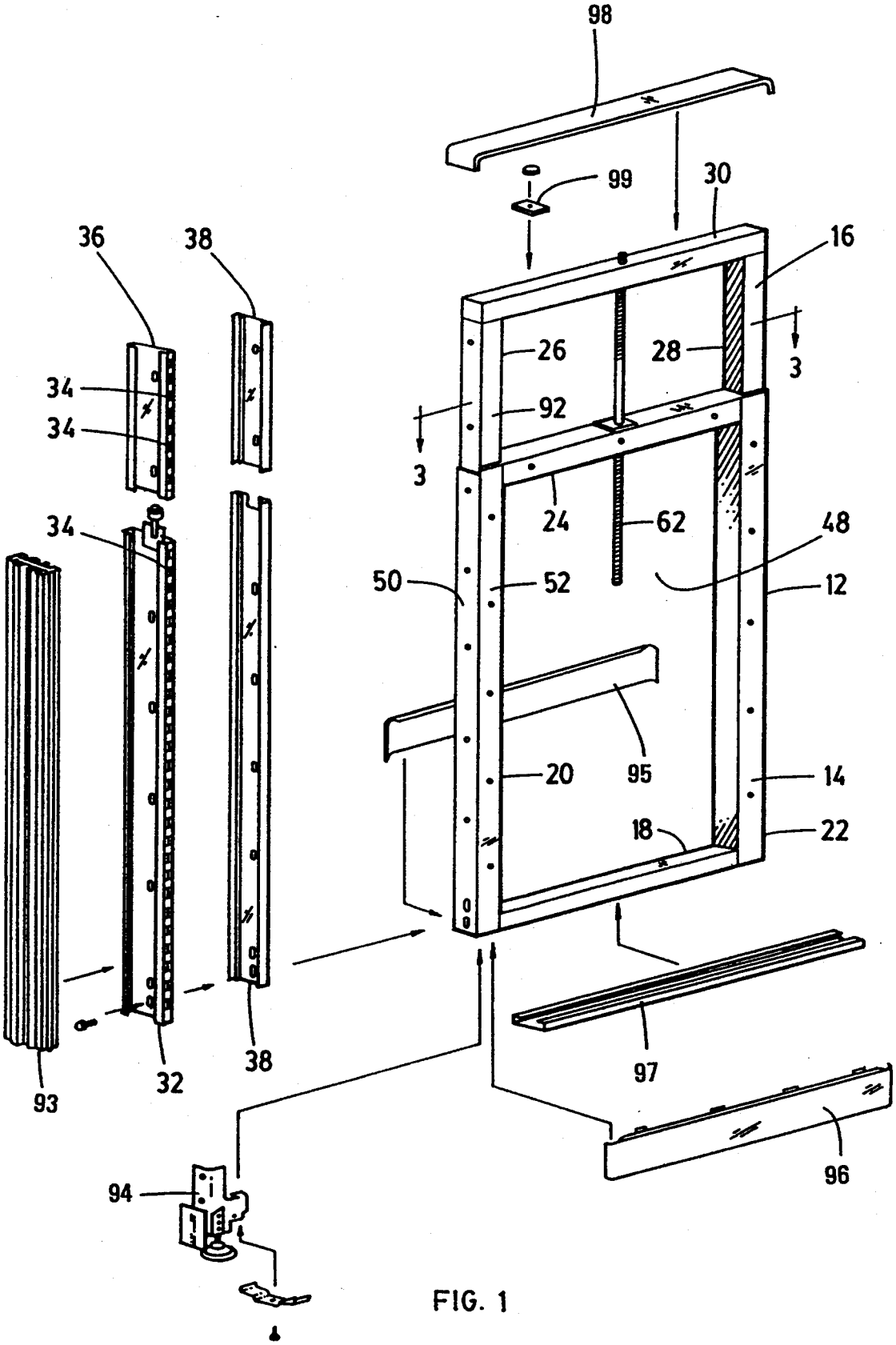
FIG. 1 is an exploded, perspective view of a partition panel embodying the present invention, wherein an extender frame portion thereof is shown in an extended position.
Figure 7:
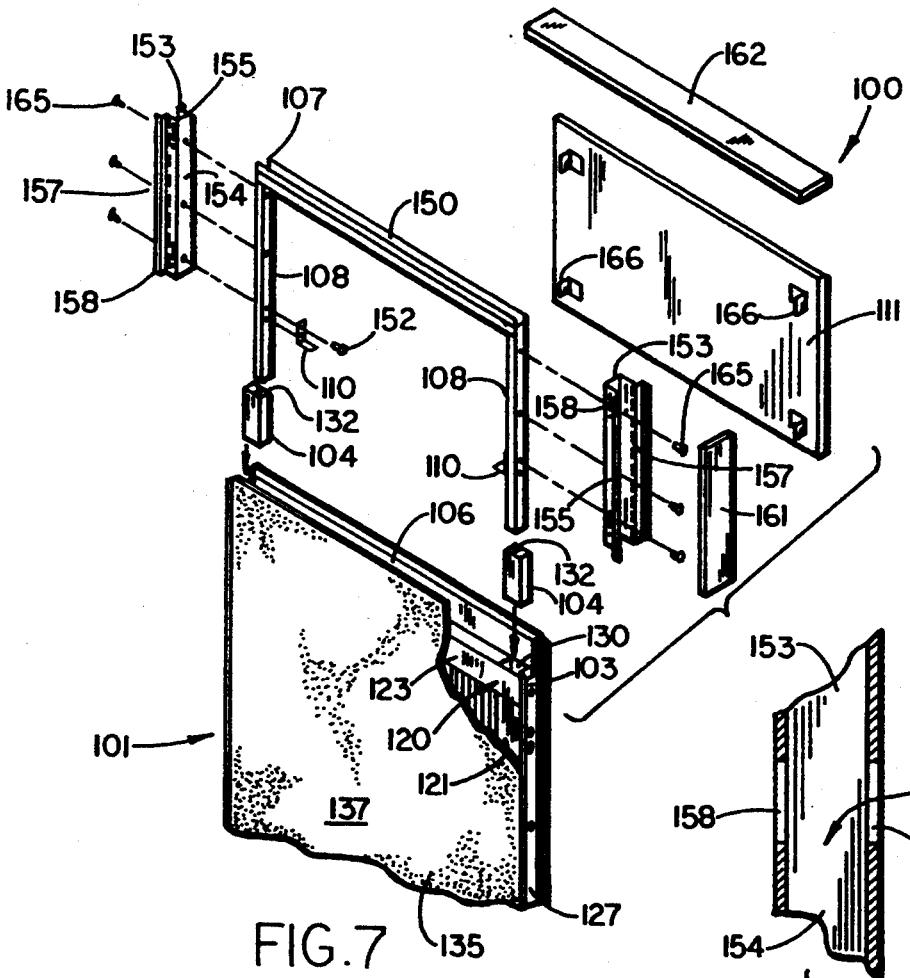
FIG. 7 is an exploded, perspective view of another embodiment of the present invention.

For purposes of description herein, the terms "upper", "lower", "right", "left", "rear", "front", "vertical", "horizontal", and derivatives thereof shall relate to the invention as oriented in FIGS. 1 and 7. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1 to 6 show a partition 10, which is one of the preferred embodiments of the present invention, and illustrates its various components.

Framework 12, most easily seen in FIG. 1, includes lower frame 14 and upper frame 16. Lower frame 14 has lower crossmember 18 and spaced apart hollow upright members 20, 22, which would be more or less vertical in use, being parallel to each other, and upper crossmember 24, being parallel to the lower crossmember. The members of the lower frame fixedly connected together to form a rectangle having two upright sides.

Figure 3:
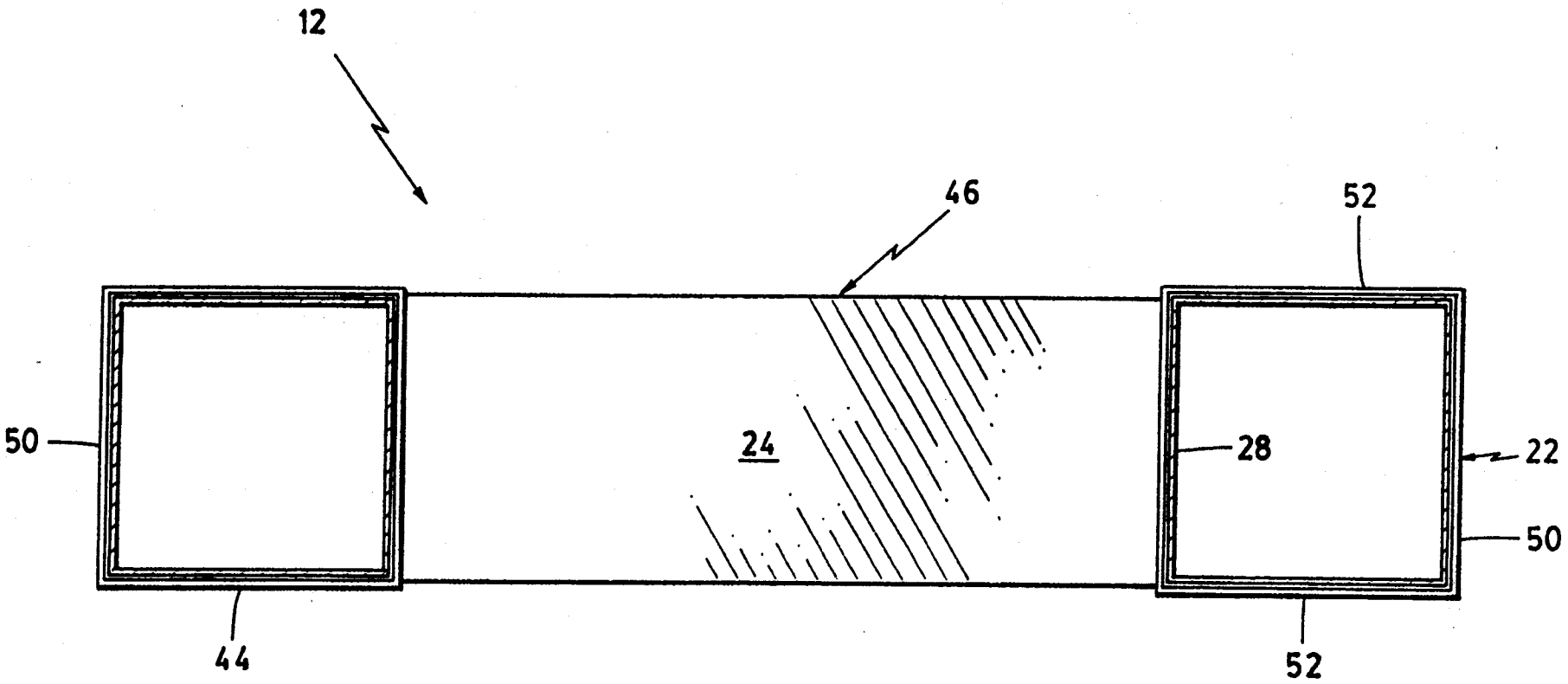
FIG. 3 is a horizontal cross-sectional view of the partition panel shown in FIG. 1, taken along the line III—III, FIG. 1.

Upper frame 16 is in the nature of an extender frame, and includes upright legs 26, 28 fixedly connected by crossarm 30. Legs 26, 28 are inserted into hollow upright members 20, 22, respectively through the upper ends thereof, which are open. In the illustrated embodiment, framing members are of a generally hollow metal such as steel tubing of approximately 18 G of square cross-section as seen in FIG. 3. The arrangement is such that the legs can slidingly move up and down within the hollow members of the lower frame such that the overall height of the extender frame 16 may be varied.

As shown most clearly in FIG. 1, there is an upright 32 for attachment to each of the upright members 20, 22 of the lower frame 14. Each upright 32 includes a plurality of linearly aligned vertically oriented equidistantly spaced slots 34 extending substantially along its length. The slots 34 are used for attachment of accessories (not shown), such as shelving brackets, as is well known in the art. Similarly, shorter uprights 36 are attached to upright legs 26, 28 of upper frame 16. Plastic members 38 interposed between the uprights and framework elements close gaps therebetween to prevent leakage of light between frame elements and the uprights, as is known in the art. The uprights 32, 36 are attached to the upright legs and members by means of thread cutting screws spaced about 6 inches (about 15 cm) apart.

Figure 2:
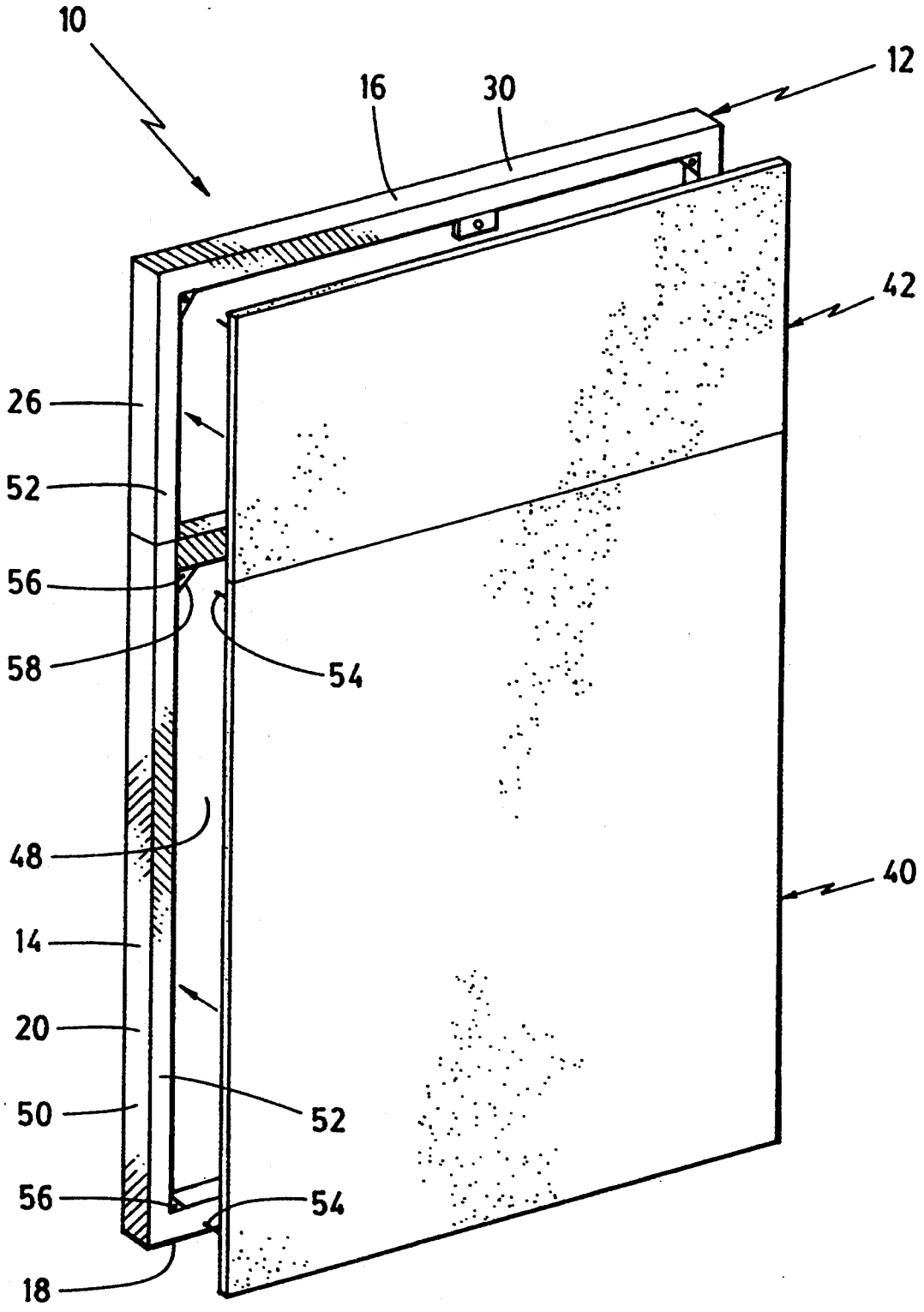
FIG. 2 is a perspective view of the partition panel shown in FIG. 1, wherein the extender frame is in the extended position, with cover panels attached to one side thereof.

Turning to FIG. 2, upholstered panels 40, 42 for attachment to lower and upper frames of the framework 12, respectively, are illustrated. The rectangular framework 12 has two major sides 44, 46 there being a set of panels 40, 42 for each such side. Each panel 40, 42 set being similar to the other, only one set is illustrated. The panels 40, 42 serve to cover the space 48 between the members of the framework. In the preferred embodiment, all but the edges 50 transverse to a major plane of the framework are covered by the panels, but it would be possible to dimension the panels to leave framework edges 52 parallel to such major plane exposed, or partially exposed if desired. The panels are attached to the framework by pins 54 which snap into apertures 56 of triangular plates 58 (see FIG. 2) secured into the interior corners of the rectangular frames 14, 16 of the framework, such fasteners being conventional.

Top panel 42 can be made available in different selected heights so that the overall partition height can be selected. Once a top panel 42 is selected, the upper frame 16 is moved upwardly from the retracted position shown in FIG. 5, fastened in the raised or extended position, as shown in FIGS. 1 and 2, and two upper panels 42 are attached to cover the space between the upper crossmember 24 of the lower frame 14, and the legs 26, 28 and crossarm 30 of the upper frame 16. The height added by extension of the top frame 16 upwardly is of course limited by the height of the legs 26, 28 of the upper frame 16, and the length of the bottom portion of the legs 26, 28 which must be retained within the lower upright members 20, 22 to maintain the integrity of the partition.

Figure 4:
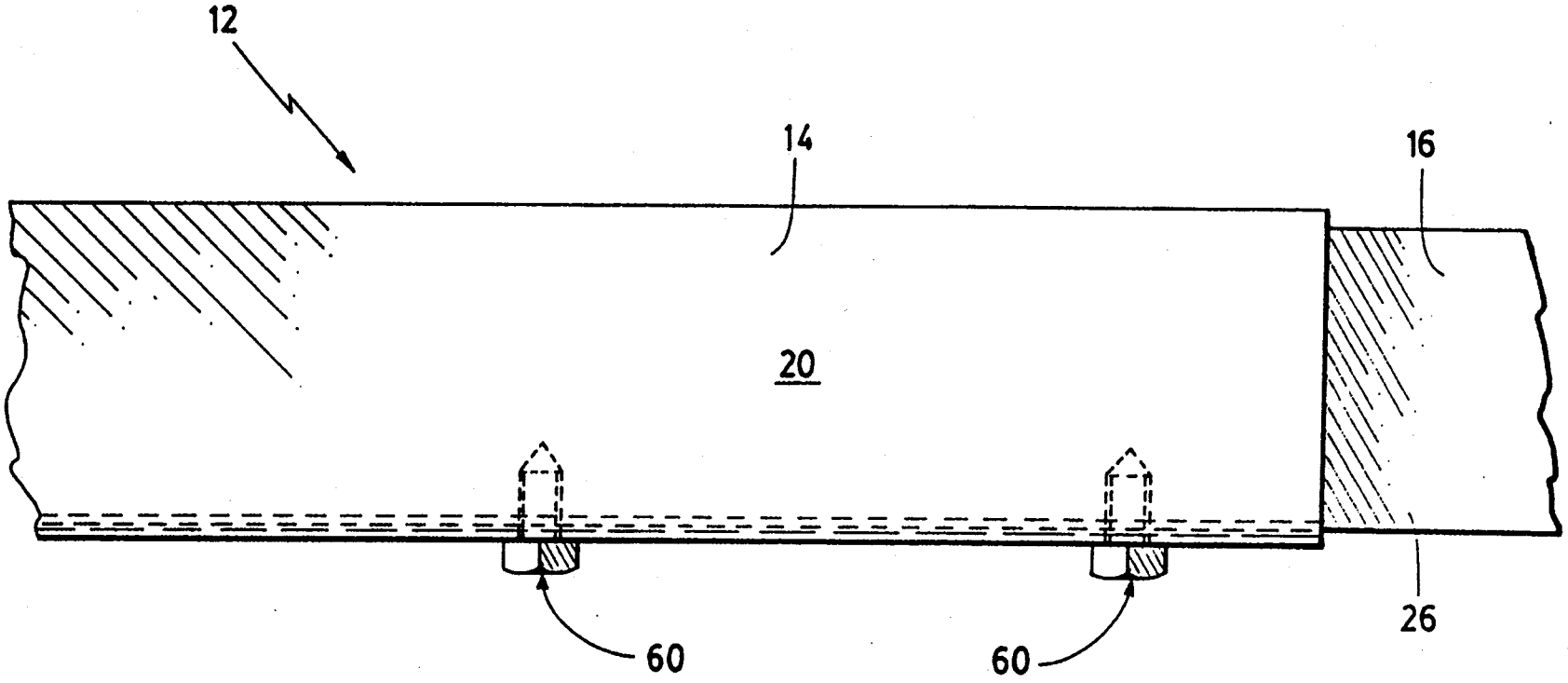
FIG. 4 is a fragmentary, cross-sectional view of the partition panel, shown in FIG. 1, particularly showing a retainer portion thereof.

Lower and upper frames 14, 16 may be fastened against movement with respect to each other by means of screws 60 having hexagonal heads ($5/16 \times \frac{1}{2}$ inch), two per upright member. The screws 60 would be spaced, as shown in FIG. 4, a few inches apart along the inside edge of the upright member through which it is screwed.

Jack 62 provides a convenient means for adjusting the height of the framework 12 prior to attachment of the upper panels 42. Further, the jack 62 serves to maintain the selected height of the framework 12.

Figure 5:
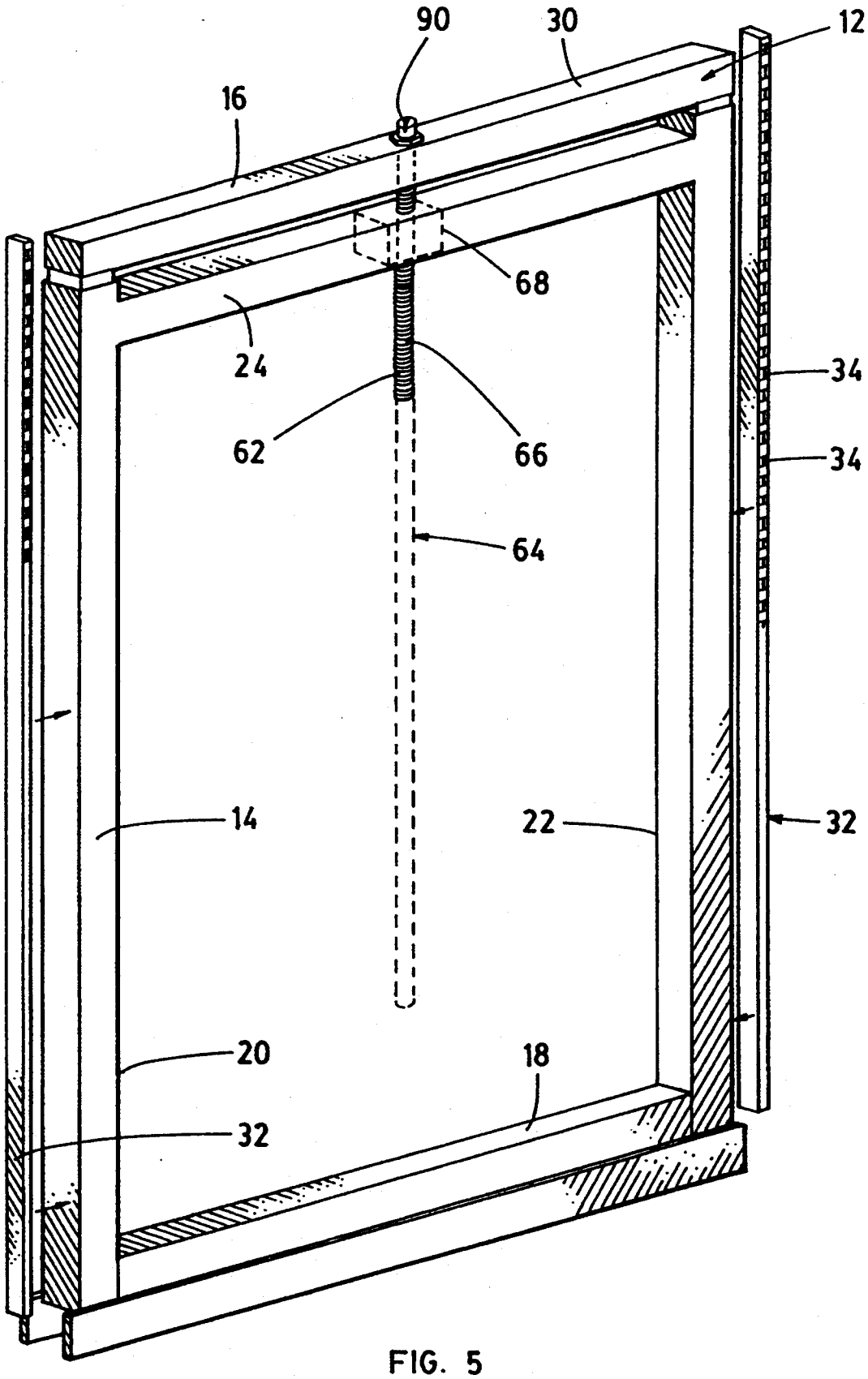
FIG. 5 is a perspective view of the partition panel, shown in FIG. 1, wherein the extender frame is in a retracted position, and the cover panels are removed.
Figure 6:
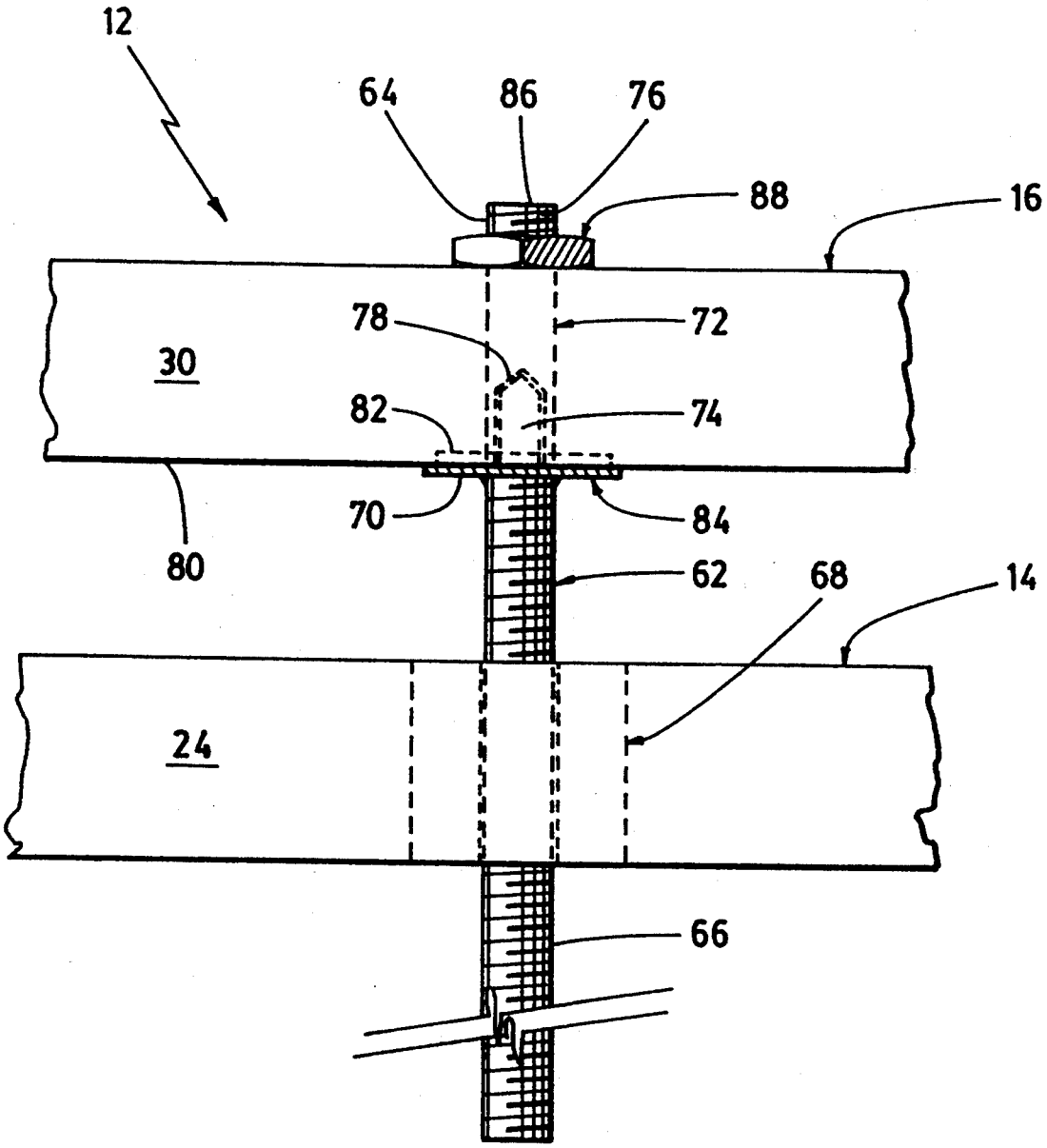
FIG. 6 is an enlarged, fragmentary elevational view of a jack portion of the partition panel shown in FIG. 1.

As seen in FIGS. 5 and 6, jack 62 includes elongate vertical rod 64. Lower threaded portion 66 of the rod 64 is threaded into a matingly threaded block 68 secured as part of the upper crossmember 24 of the lower frame of the partition. Washer 70 is secured to rod portion 66, spaced slightly downward of its top end. Crossarm 30 of the upper frame includes aperture 72 for receipt therein of the uppermost segment 74 of the lower portion of the rod therein, which uppermost segment is of reduced diameter from the remainder of the rod. Upper portion 76 of rod 64 has threaded female portion 78 for threaded receipt and engagement of threaded segment 74 therewithin. Rod portions 66, 76 are fixedly secured to each other by this engagement.

Washer 70 is dimensioned to precluded its own entry into aperture 72 of crossarm 30 and aperture 72 of the crossarm is dimensioned to allow free rotation of rod 64 therewithin. Rotation of rod 64 so as to move the rod upwardly with respect to the lower frame thus forces the upper frame in an upward direction. Conversely, rotation of rod 64 so as to move the rod downwardly permits the upper frame 16 to move downwardly under the force of gravity. Rod 64 is located midway along crossmember 24, to be centered between the legs 26, 28 of the upper frame 16 for balanced movement thereof with respect to the lower frame 14.

Underside 80 of crossarm 30 contains annular depression 82 for receipt of washer 84 to facilitate rotation of rod 64 with respect to the crossarm block 68. Further, the uppermost segment 86 of rod upper portion 76 is externally threaded and projects above the topside of crossarm 30 for threaded attachment of locking nut 88. Once the vertical position of upper frame 16 with respect to lower frame 14 has been selected, locking nut 88 is threaded onto upper portion 76 to jammingly abut the crossarm so as to prevent further rotation of rod 64. In this way the overall dimension of framework 12 may be fixed for use.

In the illustrated embodiment, the top end of rod 64 contains an aperture 90 for mating receipt of a slot or Phillips or other type of screw driver. A driver may be attached to an electric reversible drill and the drill operated to adjust the position of the upper frame upwardly or downwardly, as required, to select the desired height.

Either or both legs 26, 28 may have indicia 92 to show positions of the upper frame 12 suitable for attaching presized upper panels 42. The partition has minimum height when the upper frame 12 is in the position shown in FIG. 5, that is, when each of the legs 26, 28 is telescoped substantially entirely into the hollow upright member 20, 22 of the lower frame 14 that receives it. In this position, crossarm 30 is retracted into the space formed between the upper portions of opposed lower panels 40, so that it can be stored therein.

Conventional hinge members 93 (FIG. 1) may be fastened at lateral ends of the panel so that panels may be connected in series to each other. A vertically adjustable foot 94 is fastened at the bottom end of each upright member 20, 22 of the lower frame 14. Feet 94 which extend to support a panel so that the panel may stand on its own, may of course be used, these being well known in the art. Lower slats 95, 96 and bottom element 97 are fastened conventionally. Top cap 98 is fastened by a number of clips 99 fastened along the top edge of the crossarm 30 of the upper frame 12.

A typical upholstered member would have a 20 G steel perimeter frame and ⅜ inch (about 1 cm) thick sheet of tackable fiberglass board upholstered with a suitable fabric.

It is thus possible, within the scope of this invention to obtain a freestanding office partition which is vertically adjustable to a number of predetermined heights. A partition is freestanding if it can stand on its own or in combination with another partition upon a floor or has supporting feet connected at its bottom for such purpose. Such a panel does not generally rely on being fastened to a wall or ceiling for support, however. Such panels may have upright members for support of accessories, as illustrated above.

Figure 8:
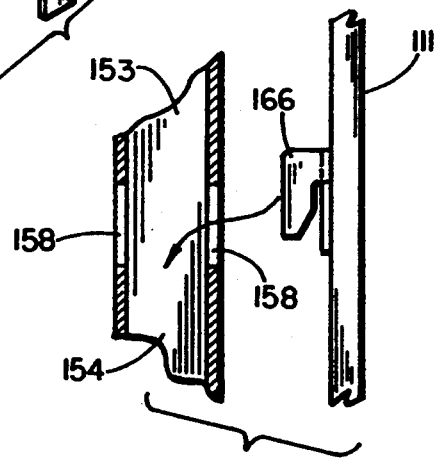
FIG. 8 is an exploded, fragmentary, cross-sectional view of the partition panel shown in FIG. 7, wherein the cover panel is being assembled to an associated frame.
Figure 9:
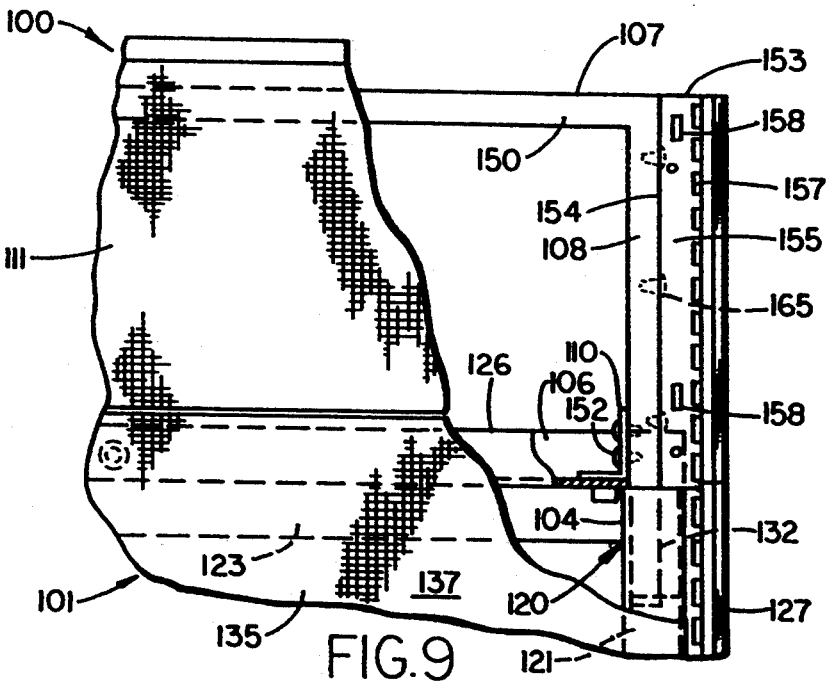
FIG. 9 is a fragmentary, front elevational view of the partition panel shown in FIG. 7, wherein portions thereof have been broken away to reveal internal construction.
Figure 15:
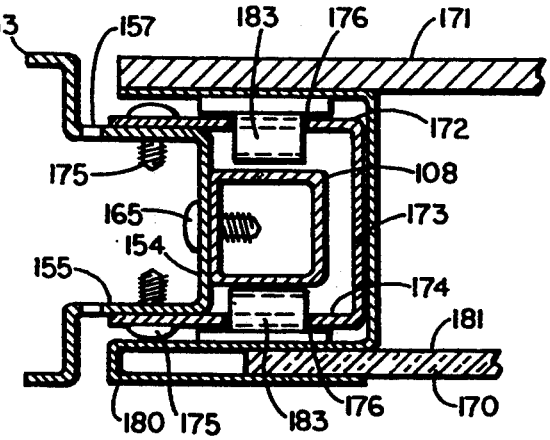
FIG. 15 is a horizontal, cross-sectional view of the partition panel shown in FIG. 11, with two functional cover panels mounted on the upper portion thereof.
Figure 16:
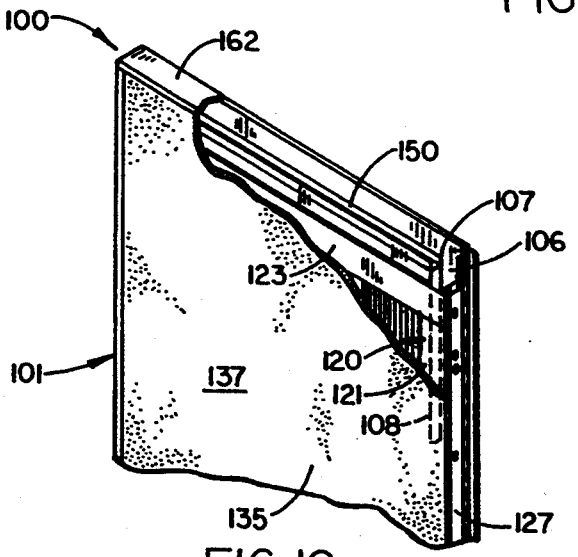
FIG. 16 is a perspective view of the partition panel shown in FIG. 7, wherein the extender frame is in a fully retracted position for storage, and portions thereof are broken away to reveal internal construction.

The reference numeral 100 (FIGS. 7–17) generally designates another partition panel embodying the present invention. Partition panel 100 is quite similar in structure and function to the previously described partition panel 10, and also comprises a vertically extensible self-storing partition panel, which includes a base panel 101 (FIG. 10) having a lower portion 102 shaped for freestanding support on a floor surface, and an upper portion 103 (FIGS. 7–9) with two vertically oriented support sleeves 104 and a storage cavity 106 therebetween. An inverted U-shaped extended frame 107 has opposite legs 108 closely received in the support sleeves 104 of base panel 101, and permits shifting extender frame 107 between an extended position above base panel 101, as shown in FIG. 9, and a retracted position within the storage cavity 106 of base panel 101, as shown in FIG. 16. When the extender frame 107 is extended, a retainer 110 holds the same in place, and at least one cover panel 111 covers the open interior of extender frame 107.

Figure 10:
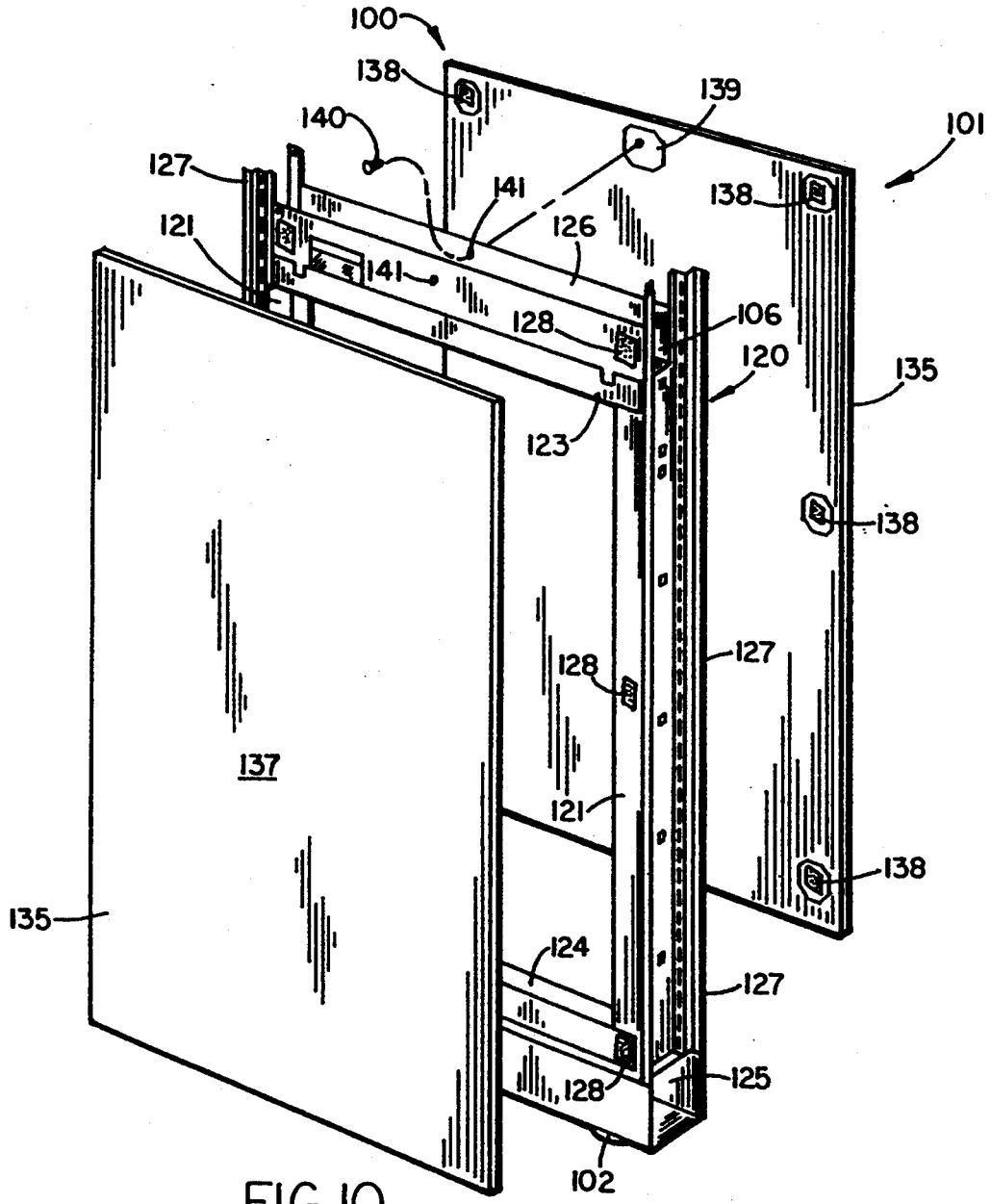
FIG. 10 is an exploded, perspective view of a base portion of the partition panel shown in FIG. 7.

With reference to FIG. 10, base panel 101 includes a rectangular, rigid frame 120, comprising a pair of vertically oriented uprights 121, which are interconnected by an upper crossarm 123 and a lower crossarm 124. A power raceway 125 is attached to and disposed immediately below the lower frame crossarm 124, and is adapted to receive therein electrical powerways, and the like (not shown). A cable trough 126 is attached to and disposed immediately above upper frame crossarm 123, and is adapted to receive therein data lines, communication cables, and the like (not shown). Hanger brackets 127 are attached to the exterior sides of frame uprights 121, and are adapted to retain thereon hang-on furniture accessories (not shown). Hook and loop fastener patches 128 are provided on the side faces of base frame 120 to assist in mounting associated cover panels, as described below.

With reference to FIG. 7, the upper frame crossarm 123 includes a pair of vertically oriented apertures 130 positioned adjacent opposite ends thereof, generally in line with frame uprights 121. Apertures 130 are shaped to receive therein support sleeves 104, which are in the form of bearing blocks with vertically oriented slide apertures 132 in which extender frame legs 108 are closely received, as described in greater detail hereinafter. Bearing blocks 104 are preferably constructed from an anti-friction material, such as nylon or another suitable synthetic resin.

Base panel 101 (FIG. 10) also includes a pair of decorative cover panels 135, which are mounted on opposite sides of base frame 120. The illustrated cover panels 135 have a one-piece laminate construction, with an upholstered exterior surface 137. A plurality of hook and loop fastener patches 138 are mounted on the interior surfaces of cover panels 135, and are positioned to mate with associated fastener patches 128 on base panel frame 120, so as to detachably mount cover panels 135 thereon. Cover panels 135 also include a fastener plate 139, positioned centrally along the upper edge thereof. A fastener 140 is inserted through a mating aperture 141 in cable trough 126, and received in fastener plate 139 to securely retain cover panels 135 on base panel frame 120. The upper edges of base cover panels 135 extend above base frame crossarm 123 to define therebetween the storage cavity 106 into which extender frame 107 is retracted for storage, as described below.

Adjacent base panels 101 are laterally interconnected by hinge connectors 145 (FIG. 13), which are similar to those disclosed in VandenHoek U.S. Pat. No. 4,144,924, and include hinge strips 146, which are connected to adjacent panels between hanger brackets 127 and clamping brackets 147.

The vertically extensible portion of partition panel 100 includes one extender frame 107, two retainers 110, and two cover panels 111. Extender frame 107 has an open, inverted U-shape configuration, wherein vertical legs 108 have their upper ends interconnected by an upper crossarm 150, and their lower ends are closely received within the slide apertures 132 of bearing blocks 104. Extender frame legs 108 have a generally square transverse cross-sectional configuration, similar to that of slide apertures 132. Extender frame 107 is configured such that it can be retracted wholly within base panel 101 and stored therein, wherein upper frame crossarm 150 is received within storage cavity 106, and the lower ends of extender frame legs 108 are received within the interiors of base frame uprights 121, as shown in FIG. 16.

In the partition panel illustrated in FIGS. 7–17, retainer 110 comprises a pair of L-shaped clips, which are attached to the interior sides of extender frame legs 108 by fasteners 152, and assist in retaining extender frame 107 in its fully extended, upright condition, as shown in FIG. 9. A pair of height extension brackets 153 are attached to the exterior sides of extender frame legs 108, and also assist in retaining extender frame 107 in its fully extended, upright condition. Height extension brackets 153 each have a generally U-shape transverse cross-sectional configuration which opens outwardly away from the center of the partition panel 100, and includes a central web 154 and opposing flanges 155. In the example shown, each of the flanges 155 on height extension bracket 153 includes a vertical column of slots 157, which may be used to support hang-on furniture units, similar to those provided in the hanger brackets 127 on base panel 101. Each flange 155 of height extension bracket 153 also includes a pair of vertical slots 158 to mount a pair of upper cover panels 111 to the opposite sides of extender frame 107, as described below and shown in FIG. 14. A pair of upper side trim strips 161 (FIG. 7) are provided to enclose the open ends of height extension brackets 153. A top cap 162 is provided to cover the upper portion of extender frame 107.

Each height extension bracket 153 (FIGS. 7–9) is attached to the exterior side of its associated extender frame leg 108 by one or more threaded fasteners 165, which are accessible by removal of trim strips 161. The upper cover panels 111 shown in FIGS. 7–9 are decorative in nature, and are substantially identical in construction to the lower cover panels 135, having a composite, laminate construction with a layer of fabric adhered to the exterior surface thereof. It is to be understood that upper cover panels 111 may have alternative constructions, including a conventional upholstered frame type of arrangement. Four, downwardly oriented L-shaped hooks 166 protrude rearwardly from the interior surface of each upper cover panel 111, and are shaped to be inserted into the vertical slots 158 in extension brackets 153 as shown in FIG. 8, so as to mount upper cover panels 111 on the opposite sides of extender frame 107. The top cap 162 is attached to the upper crossarm 150 of extender frame 107, and extends between the opposite upper edges of adjacent upper cover panels 111, so as to completely and fully enclose the extensible portion of partition panel 100.

In operation, the vertically extensible portion of partition panel 100 can be provided as a complete kit to retrofit an existing base panel 101, or alternatively, extender frame 107 can be factory installed and stored in base panel 101, the choice depending upon the desires of the specific customer and/or application. In either event, if a vertical add-on panel is desired on top of a base panel 101, an authorized installer accomplishes the assembly in the following fashion.

The existing top cap 162 on base panel 101 is first removed. In the event base panel 101 is already equipped with a self-storing extender frame 107, extender frame 107 is simply extended upwardly to its fully upright position. In the event the base panel 101 is not equipped with a self-storing extender frame 107, an extender frame 107 is first installed in base panel 101 by inserting a pair of the plastic bearing blocks 104 in vertical frame apertures 130. The lower ends of extender frame arms 108 are then inserted into the slide apertures 132 in plastic bearing blocks 131, and the height of extender frame 107 is adjusted to its fully extended position.

A pair of the retention clips 110 (FIGS. 7 & 9) are then mounted on the interior sides of extender frame arms 108 by fasteners 152, and a pair of height extension brackets 153 are attached to the exterior sides of extender frame arms 108 by fasteners 165. Next, a pair of upper cover panels 111 are attached to the opposite sides of extender frame 107 by inserting hooks 166 into the vertical slots 158 in height extension brackets 153, and then sliding upper cover panels 111 vertically downwardly into a locked position. Side trim strips 161 and top cap 162 are then installed to complete the assembly.

A vertically extended partition panel 100 can be lowered to its original base panel height by simply reversing the sequence of steps identified above. Extender frame 107 can either be stored in base panel 101, or removed and stored off site.

Figure 11:
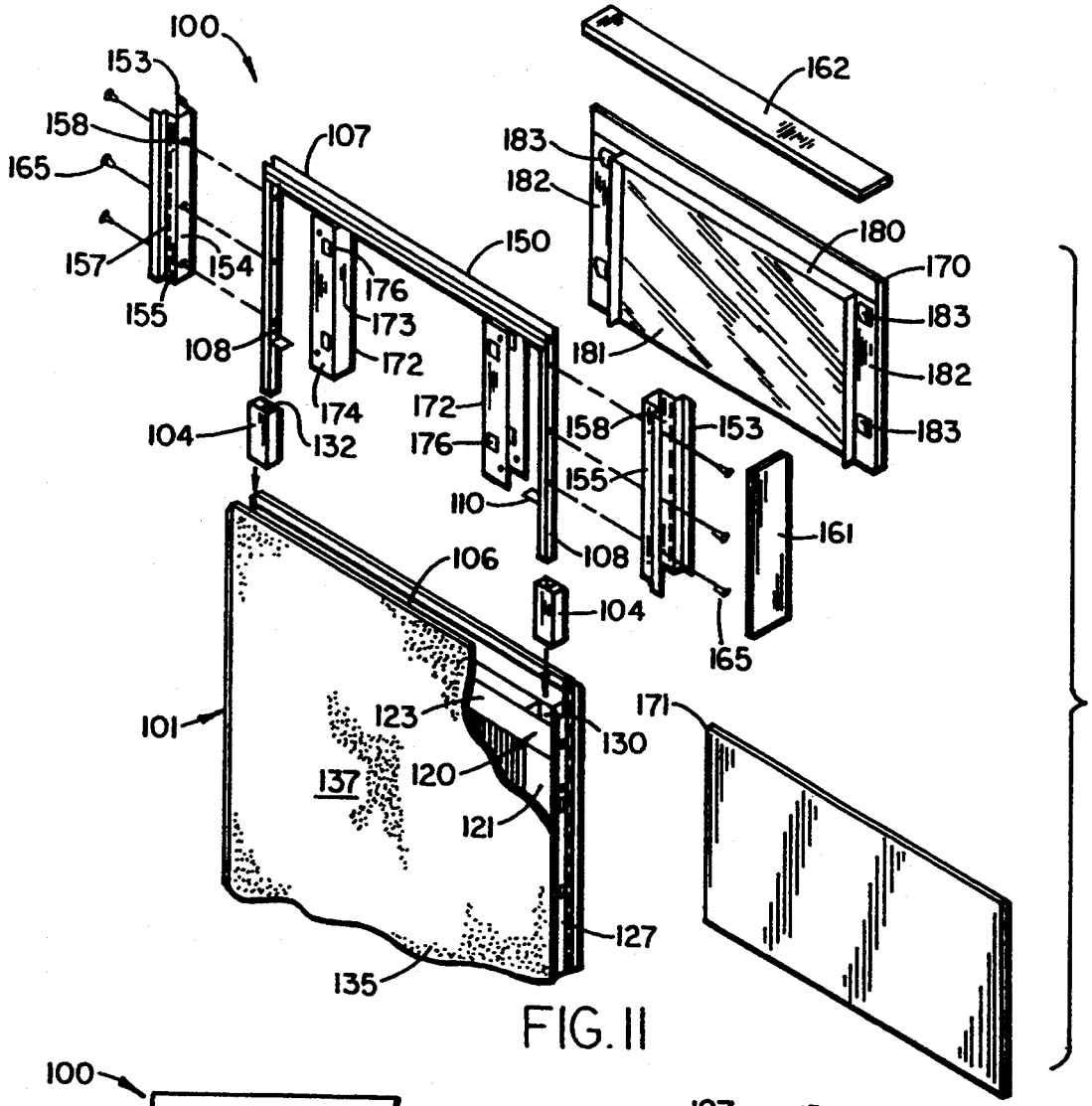
FIG. 11 is an exploded, perspective view of the partition panel shown in FIG. 7, wherein two functional type of cover panels are mounted on the upper portion thereof.
Figure 12:
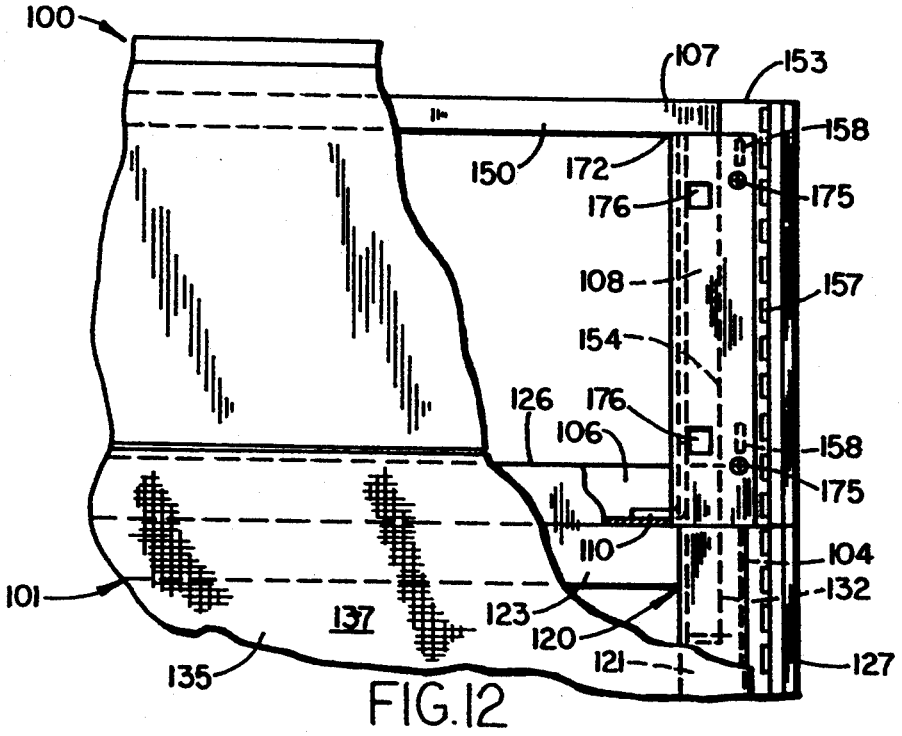
FIG. 12 is a fragmentary, front elevational view of the partition panel shown in FIG. 7, wherein functional panels are mounted on the upper portion thereof.
Figure 13:
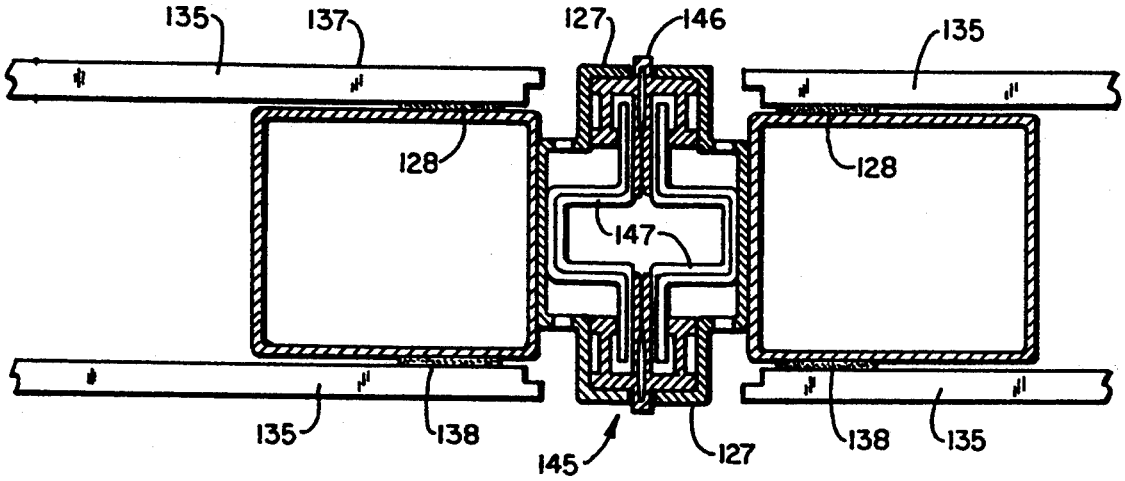
FIG. 13 is a horizontal, cross-sectional view of a pair of the partition panels interconnected in a side-by-side relationship.
Figure 14:
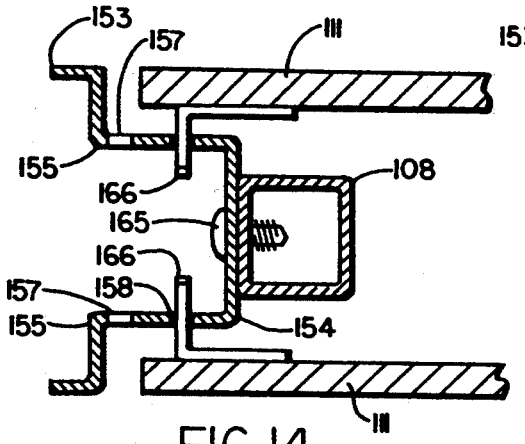
FIG. 14 is a horizontal, cross-sectional view of the partition panel shown in FIG. 7, with decorative cover panels mounted on the upper portion thereof.

With reference to FIGS. 11 and 12, optional glass and marker board upper panels 170 and 171 respectively, may be provided to replace one or more of the upholstered upper cover panels 111. To install optional cover panels 170 or 171 on both sides of extender frame 107, a pair of frame adaptors 172 are provided, each of which has a generally U-shape transverse cross-sectional configuration, comprising a central web 173, and a pair of outwardly extending flanges 174. Frame adaptors 172 are mounted on extender frame 107 by positioning the same on the interior sides of extender frame legs 108, and then inserting flanges 174 over the flanges 155 of adjacent height extension brackets 153. As illustrated in FIG. 15, fasteners 175 extend laterally through the flanges 174 of frame adaptors 172, and into mating apertures formed in the flanges 155 of height extension brackets 153. Frame adaptors 172 are thereby securely mounted in place, and serve to further rigidify extender frame 107 on base frame 101, and also enclose the interior side portions of extender frame 107. Each frame adaptor 172 includes a pair of windows 176 (FIGS. 11 & 12) through opposite flanges 174, which serve to mount either an optional glass panel 170 or a marker board panel 171, as described below.

The illustrated glass panel 170 (FIG. 11) includes an inverted U-shape marginal frame 180 on which a sheet of glass 181 is mounted. The opposite side portions 182 of frame 180 include a pair of downwardly oriented tongues 183, which are shaped to be closely received within the mating windows 176 in frame adaptors 172, as shown in FIG. 15. The mounting tongues 183 on optional cover panels 170 and 171 are substantially wider than the hooks 166 on decorative cover panels 111, so that the same can not be interchanged, as described below. Glass panel 181 can be provided in a wide variety of different surface finishes, including clear, frosted, tinted, etc. When glass panels 181 are provided with a clear surface finish, both sides of extender frame 107 are typically provided with a similar clear glass upper cover panel 170, so as to form a see-through window or light.

The marker board panel 171 (FIG. 11) is substantially identical to glass panel 170, except that the exterior surface thereof is provided with a special smooth finish adapted for use with an erasable marker, or other similar writing instrument.

In operation, optional glass cover panels 170 and marker cover panels 171 can be used to replace an upholstered upper cover panel 111. A qualified furniture installer is required to reconfigure the panels 100 in the following fashion. When both sides of extender frame 107 are to be provided with one of the optional cover panels 170 or 171, both of the upholstered upper cover panels 111 are first removed from extender frame 107 in the manner described hereinabove. A pair of frame adaptors 172 are then fastened to the legs 108 of extender frame 107 by fasteners 175. Frame adaptors 172 serve to further rigidify extender frame 107 for the heavier optional cover panels, and better secure their attachment to base frame 120. Also, the U-shape of frame adaptors 172 serves to cover retainer clips 132, as well as the exposed portions of extender frame legs 108, and associated fasteners 165 and 175, so as to provide the interior of extender frame 107 with a neat appearance, which is particularly beneficial when clear glass cover panels 170 are used to create a window. It will be noted that when frame adaptors 172 are mounted in place on extender frame arms 108, as shown in FIG. 15, decorative panel mounting slots 158 (FIG. 14) are fully covered, so that an upholstered upper cover panel 111 cannot be inadvertently positioned on the reconfigured panel 1.

The selected glass and marker cover panels 170 and 171 are then mounted onto frame adaptors 172 by inserting the corresponding tongues 183 into the adjacent bracket windows 176, and then sliding the selected cover panels 170 and 171 vertically downwardly into a locked position. It is to be noted that due to the wide shape and unique positioning of panel tongues 183, optional glass panels 170 and marker panels 171 cannot inadvertently be installed on the extender frame 107, without first installing frame adaptors 172.

Figure 17:
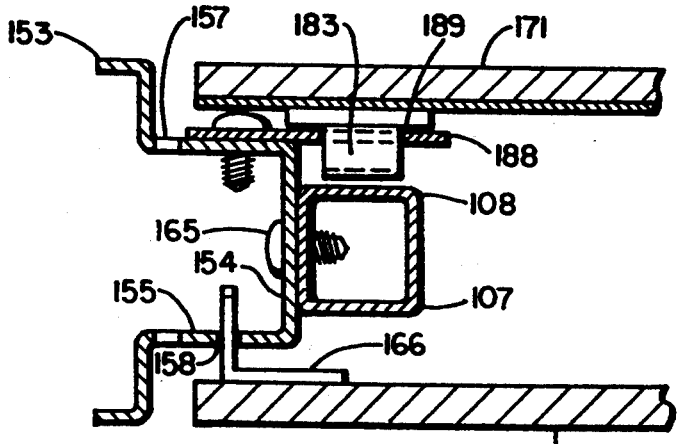
FIG. 17 is a horizontal, cross-sectional view of the partition panel, with a decorative cover panel mounted on one side thereof, and a functional cover panel mounted on the opposite side thereof.

With reference to FIG. 17, extender frame 107 may also be equipped with an upholstered upper cover panel 111 on one side, and an optional cover panel 170 or 171 on the opposite side. Under normal circumstances, a clear glass cover panel would not be used in this particular arrangement, although the same is certainly possible. In the example shown in FIG. 17, an optional marker cover panel 171 is shown mounted opposite an upholstered upper cover panel 111. To accomplish this type of modification, a pair of flat frame adaptors 188 are provided, each of which has a generally flat or plate-like shape. Flat frame adaptors 188 are mounted at opposite sides of extender frame 107 by positioning the same on the exterior faces of bracket flanges 155, so as to cover bracket slots 158, while leaving hanger slots 157 fully exposed and accessible. Fasteners 175 are inserted laterally through flat frame adaptors 158, and into the underlying apertures in the flanges 155 of height extension brackets 153. Each flat frame adaptor 188 includes a pair of windows 189, which are shaped and positioned identical to frame adaptor windows 176, so as to receive therein associated tongues 183 on marker cover panel 171. Marker cover panel 171 is installed on flat frame adaptors 188 by inserting the corresponding tongues 183 into the adjacent bracket windows 189, and then sliding marker cover panel 171 vertically downwardly into a locked position. Upholstered upper cover panel 111 is mounted on the opposite side of extender frame 107 in the manner described above.

In the foregoing description, it will be readily appreciated by those skilled in the art that modifications may be made to the invention without departing from the concepts disclosed herein. Such modifications are to be considered as included in the following claims, unless these claims expressly state otherwise.

The embodiments of the invention in which an exclusive property or privilege is claimed are defined as follows:

1. A vertically extensible self-storing partition panel, comprising:

a base panel having a lower portion thereof shaped for freestanding support on an associated floor surface, and an upper portion therefor with two vertically oriented support sleeves and a storage cavity therebetween;

an extender frame including first and second upright legs having upper ends thereof interconnected by a laterally extending crossarm to define an open interior, and lower ends thereof closely received in the support sleeves of said base panel to permit shifting said extender frame between an extended position wherein said extender frame crossarm is disposed above said base panel to increase the overall height of said panel, and a fully retracted position wherein said extender frame crossarm is disposed wholly within the storage cavity of said base panel for storage;

a retainer interconnecting said extender frame and said base panel when said extender frame is in said extended position; and at least one cover panel connected with said extender frame when said extender frame is in said extended position, and covering the open interior of said extender frame.

2. A partition panel as set forth in claim 1, including:

a top cap connected with and covering the upper portion of said base panel when said extender frame is in said fully retracted position.

3. A partition panel as set forth in claim 2, wherein:

said top cap is connected with and covers said extender frame crossarm when said extender frame is in said extended position.

4. A partition panel as set forth in claim 3, wherein:

said cover panel defines a first cover panel detachably connected with and covering one side of said extender frame; and including a second cover panel detachably connected with and covering an opposite side of said extender frame.

5. A partition panel as set forth in claim 4, including:

first and second brackets connected with the first and second legs of said extender frame when said extender frame is in said extended position.

6. A partition panel as set forth in claim 5, wherein:

said first and second brackets include hanger slots to facilitate mounting thereon hang-on furniture accessories.

7. A partition panel as set forth in claim 6, wherein:

said base panel includes a pair of spaced apart, elongated, hollow uprights with open upper ends which define said support sleeves.

8. A partition panel as set forth in claim 7, wherein:

said base panel includes an upper crossarm rigidly connected with upper ends of said base panel support sleeves; and said retainer includes a longitudinally extensible jack having a first portion thereof connected with said extender frame crossarm, and a second portion thereof connected with said base panel crossarm, whereby extension and retraction of said jack raises and lowers said extender frame.

9. A partition panel as set forth in claim 8, wherein:

said jack comprises an elongate, vertically oriented externally threaded member having an upper portion thereof rotatably mounted in said extender frame crossarm, and a lower portion thereof threadedly received in a threaded block mounted on said base panel crossarm, whereby rotation of said threaded member vertically shifts said extender frame.

10. A partition panel as set forth in claim 9, wherein:

said jack is positioned centrally between the upright legs of said extender frame.

11. A partition panel as set forth in claim 10, wherein:

said threaded member has an upper end shaped for detachable engagement with a tool to facilitate rotation of said threaded member.

12. A partition panel as set forth in claim 6, wherein:
said base panel includes a pair of bearing blocks mounted adjacent opposite sides of said base panel upper portion with slide apertures which define said support sleeves.

13. A partition panel as set forth in claim 12, wherein:
said retainer includes a pair of clips fastened to said base frame and the legs of said extender frame.

14. A partition panel as set forth in claim 13, wherein:
said first and second cover panels are decorative cover panels.

15. A partition panel as set forth in claim 14, including:
at least one functional cover panel shaped to cover one side of said extender frame; and
a pair of frame adaptors connected with said extender frame, and including means for detachably mounting said functional cover panel thereon.

16. A partition panel as set forth in claim 15, wherein:
said frame adaptors have a generally U-shaped lateral cross-sectional configuration, and are positioned to cover said clips, and selected portions of said extender frame legs and said brackets.

17. A partition panel as set forth in claim 16, wherein:
said mounting means on said frame adaptors include windows shaped to closely receive therein mating hooks on said functional cover panel; and
said bracket hanger slots are shaped different than said frame adaptor windows, such that said functional cover panel can not be mounted on said brackets.

18. A partition panel as set forth in claim 17, wherein:
said functional cover panel comprises a window panel.

19. A partition panel as set forth in claim 17, wherein:
said functional cover panel comprises a marker panel.

20. A partition panel as set forth in claim 1, including:
first and second brackets connected with the first and second legs of said extender frame when said extender frame is in said extended position.

21. A partition panel as set forth in claim 20, wherein:
said first and second brackets include hanger slots to facilitate mounting thereon hang-on furniture accessories.

22. A partition panel as set forth in claim 1, wherein:
said base panel includes a pair of spaced apart, elongated, hollow uprights with open upper ends which define said support sleeves.

23. A partition panel as set forth in claim 1, wherein:
said base panel includes an upper crossarm rigidly connected with upper ends of said base panel uprights; and
said retainer includes a longitudinally extensible jack having a first portion thereof connected with said extender frame crossarm, and a second portion thereof connected with said base panel crossarm, whereby extension and retraction of said jack raises and lowers said extender frame.

24. A partition panel as set forth in claim 23, wherein:
said jack comprises an elongate, vertically oriented externally threaded member having an upper portion thereof rotatably mounted in said extender frame crossarm, and a lower portion thereof threadedly received in a threaded block mounted on said base panel crossarm, whereby rotation of said threaded member vertically shifts said extender frame.

25. A partition panel as set forth in claim 1, wherein:
said base panel includes a pair of bearing blocks mounted adjacent opposite sides of said base panel upper portion with slide apertures which define said support sleeves.

26. A partition panel as set forth in claim 1, wherein:
said retainer includes a pair of clips fastened to said base frame and the legs of said extender frame.

27. A partition panel as set forth in claim 1, wherein:
said first and second cover panels are decorative cover panels.

28. A partition panel as set forth in claim 1, including:
at least one functional cover panel shaped to cover one side of said extender frame; and
a pair of frame adaptors connected with said extender frame, and including means for detachably mounting said functional cover panel thereon.

29. A partition panel as set forth in claim 28, wherein:
said frame adaptors have a generally U-shaped lateral cross-sectional configuration, and are positioned to cover said clips, and selected portions of said extender frame legs and said brackets.

30. A partition panel as set forth in claim 29, wherein:
said mounting means on said frame adaptors includes windows shaped to closely receive therein mating hooks on said functional cover panel; and
said bracket hanger slots are shaped differently than said frame adaptor windows, such that said functional cover panel can not be mounted on said brackets.

* * * * *